United States Patent [19]

Spars et al.

[11] 4,456,525

[45] Jun. 26, 1984

[54] PROCESS FOR COKING CONTAMINATED PYROLYSIS OIL ON HEAT TRANSFER MATERIAL

[75] Inventors: Byron G. Spars, Mill Valley; Robert J. Klett, San Francisco; P. Henrik Wallman, Berkeley, all of Calif.

[73] Assignee: Chevron Research Company, San Francisco, Calif.

[21] Appl. No.: 495,365

[22] Filed: May 16, 1983

[51] Int. Cl.[3] ..... C10G 1/02

[52] U.S. Cl. ..... 208/11 R; 208/106

[58] Field of Search ..... 208/11 R, 50, 131, 106

[56] References Cited

U.S. PATENT DOCUMENTS

| | | | |
|---|---|---|---|
| 2,489,702 | 11/1949 | Coast | 208/11 R |
| 2,579,398 | 12/1951 | Roetheli | 208/11 R |
| 2,738,315 | 3/1956 | Martin et al. | 208/11 R |
| 2,984,602 | 5/1961 | Nevens et al. | 208/11 R |
| 3,018,243 | 1/1962 | Nevens | 208/11 |
| 3,034,979 | 5/1962 | Nevens | 208/11 |
| 3,093,571 | 6/1983 | Fish et al. | 208/11 R |
| 3,560,367 | 2/1971 | Parker | 208/101 X |
| 3,850,739 | 11/1974 | Wunderlich et al. | 208/11 R |
| 3,954,597 | 5/1976 | Morrell | 208/11 |
| 4,113,602 | 9/1978 | Gorbaty et al. | 208/8 |
| 4,157,245 | 6/1979 | Mitchell et al. | 48/197 R |
| 4,199,432 | 4/1980 | Tamm et al. | 208/8 |
| 4,219,402 | 8/1980 | DeGeorge | 208/8 |
| 4,289,603 | 9/1981 | DeGeorge | 208/8 |
| 4,293,401 | 10/1981 | Sieg et al. | 208/11 R |
| 4,320,795 | 3/1982 | Gwyn et al. | 165/1 |
| 4,336,127 | 6/1982 | Bertelsen | 208/11 R |
| 4,392,942 | 7/1983 | Wallman et al. | 208/11 R |

OTHER PUBLICATIONS

Cameron Synthetic Fuels Report, Mar., 1981.

*Primary Examiner*—Delbert E. Gantz
*Assistant Examiner*—Lance Johnson
*Attorney, Agent, or Firm*—S. R. LaPaglia; W. K. Turner; D. P. Freyberg

[57] ABSTRACT

The heavy oil fraction of pyrolysis oil vapors containing concentrated contaminants is coked on hot heat transfer material. The coke-containing heat transfer material is then mixed with raw feed in a retorting vessel provided with an inert stripping gas of a velocity sufficient to lower the dew point of the pyrolysis oil.

8 Claims, 5 Drawing Figures

PROCESS FOR COKING CONTAMINATED PYROLYSIS OIL ON HEAT TRANSFER MATERIAL

BACKGROUND OF THE INVENTION

Oil shale is a naturally occurring material which contains a hydrocarbonaceous component referred to as kerogen. Upon heating, the kerogen decomposes to release a hydrocarbon vapor which may be used as a feedstock in petroleum processing. This synthetic crude oil called "shale oil" contains relatively high levels of iron, arsenic, and nitrogen as compared to conventional petroleum. In addition, due to the fissile nature of the raw oil shale and to the friability of the inorganic residue remaining after pyrolysis, the shale oil is also contaminated with a significant amount of fine solids which may constitute as much as 10% by weight of the pyrolysis oil. This contamination usually must be reduced prior to downstream processing to prevent poisoning of the various catalysts and clogging of the equipment.

Another naturally occurring raw material for production of pyrolysis oil is tar sand that occurs naturally in a variety of forms including fine-grain diatomite. In analogy to the kerogen in oil shale, bitumen in tar sands may be pyrolyzed to yield a pyrolysis oil similar to shale oil. Particulate contamination in tar sands derived oil is similar to that in shale oil.

The present invention is directed to a process for recovering pyrolysis oil from oil shale or tar sands of significantly reduced contamination and having a lower average molecular weight than otherwise may be recovered by the pyrolysis of these raw materials.

BRIEF DESCRIPTION OF THE INVENTION

The present invention is directed to an improved process for retorting a hydrocarbonaceous solid selected from the group consisting of oil shale and tar sand to recover pyrolysis oil of a lower average molecular weight and containing less contamination which comprises:

(a) pyrolyzing a particulate raw hydrocarbonaceous solid by mixing it with a hot particulate heat transfer material in a retorting vessel and maintaining said mixture at a temperature sufficient to pyrolyze the solid hydrocarbonaceous fraction for a time sufficient to decompose a significant amount of the solid hydrocarbonaceous fraction to hydrocarbon vapors;

(b) passing an inert stripping gas through the mixture of hydrocarbonaceous solids and heat transfer material at a rate sufficient to significantly lower the dew point of the evolved hydrocarbon vapors;

(c) recovering as a pyrolysis product from the raw hydrocarbonaceous solid a contaminated hydrocarbon vapor;

(d) separating from the contaminated vapor a high-boiling fraction containing concentrated contaminants;

(e) contacting the contaminated high-boiling fraction with at least a portion of the hot heat transfer material in a coking zone prior to said heat transfer material being mixed with the raw hydrocarbonaceous solid so as to thermally crack the high-boiling fraction and to deposit the contaminants along with coke on the heat transfer material;

(f) recovering a product oil from the coking zone having a lower average molecular weight and having substantially reduced contamination as compared to the high-boiling fraction; and (g) mixing the coked heat transfer material with the raw hydrocarbonaceous solid.

The term "hydrocarbonaceous solids" refers to oil shale and tar sands. Likewise, the term "solid hydrocarbonaceous fraction" refers to kerogen in the case of oil shale and bitumen in case of tar sands. The term "inert stripping gas" refers to a non-oxidizing gas such as steam, nitrogen, carbon dioxide, recycle gas, natural gas, etc. "As used herein, the word "contamination" or "contaminants" refers to fine solids, metals, and nonmetals which must be removed prior to refining. Thus, the term includes fine particles of pyrolyzed or feed solids, heat transfer material, and coke as well as compounds containing iron, nitrogen, arsenic, magnesium, calcium, sodium, sulfur, etc.

The heat transfer material is preferably recycled pyrolyzed oil shale or tar sand which has been passed through a combustion zone to burn off any carbonaceous residue to provide heat for pyrolyzing the raw material. Other suitable heat transfer materials include particulate solids succh as sand, rock, alumina, steel, ceramic compositions, etc., as well as mixtures of these materials.

Various types of retorting vessels are suitable for use with the present invention. In one preferred embodiment the retorting vessel is a vertical vessel designed to control the gross vertical backmixing of the solids. For example, a retorting vessel employing a moving packed bed or a staged turbulent bed (see U.S. Pat. No. 4,199,432) would be satisfactory for practicing the process. The presence of stripping gas in the pyrolysis oil vapor serves to lower the condensation temperature for a given heavy oil fraction. A lower temperature prevents premature coking of the heavy oil fraction in the heavy oil condenser. The high-boiling fraction may be in a liquid or partially liquid-partially vapor state when entering the coking zone. Steam may be added to the high-boiling fraction for atomization prior to injection into the coking zone. The hot heat transfer material provides a satisfactory medium for coking the contaminated hydrocarbon fraction and thus also for removing the fine particulates with the coke.

DETAILED DESCRIPTION OF THE INVENTION

Figure 1:
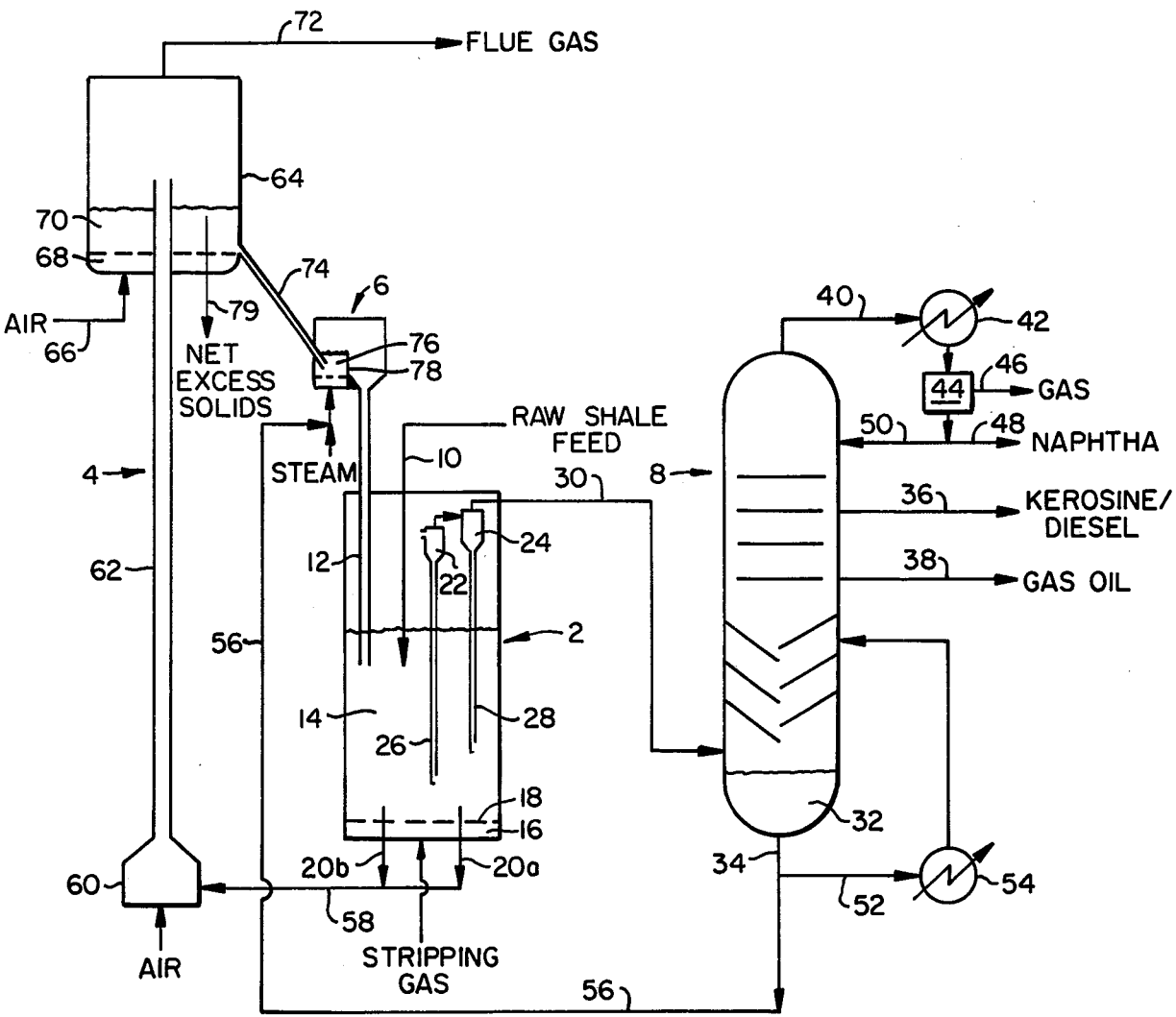
FIG. 1 illustrates a process for retorting oil shale wherein the coking zone is in the form of a fluidized bed.
Figure 2:
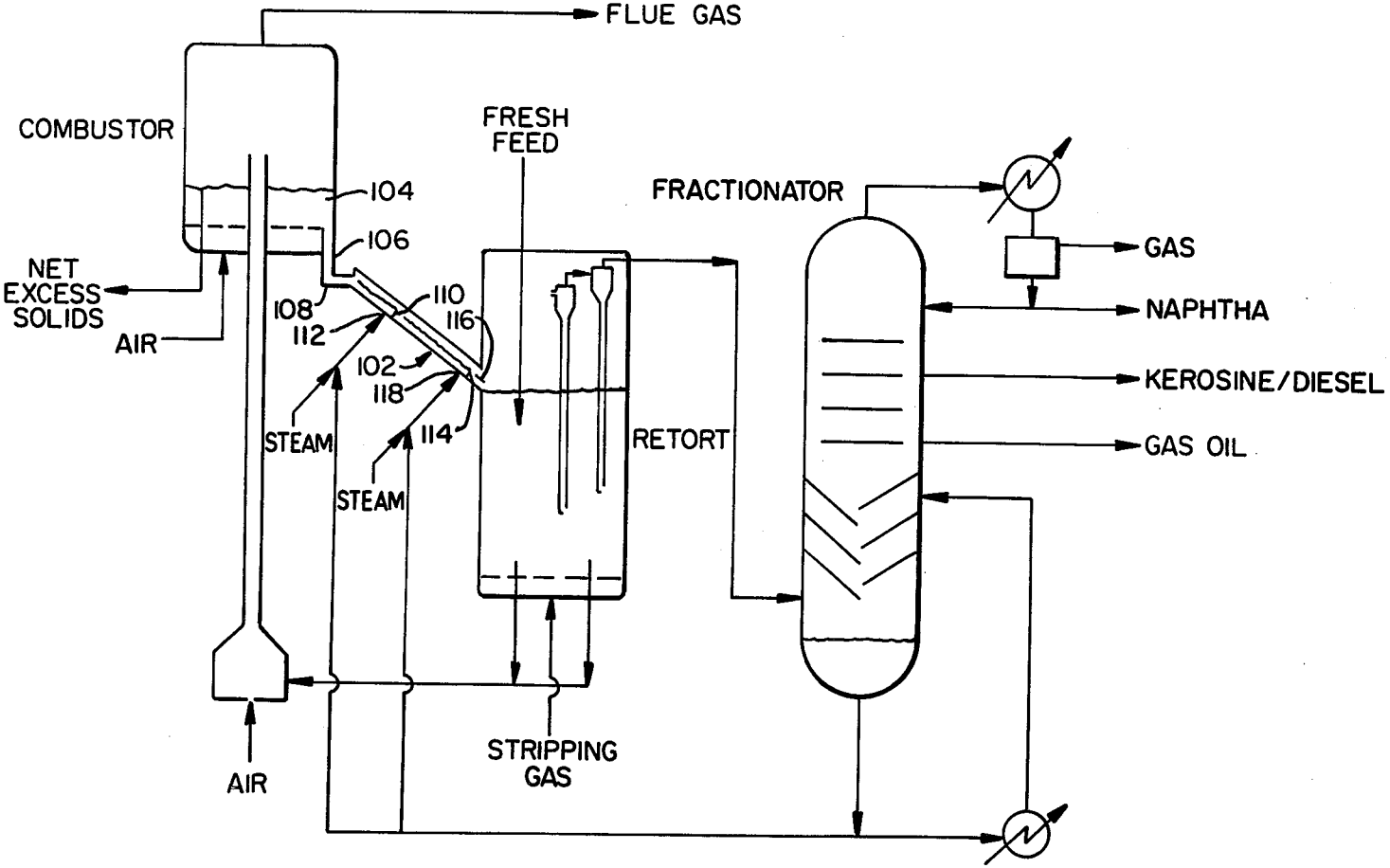
FIG. 2 shows an alternative process scheme wherein the coking zone is in the form of a partially fluidized feed chute between the combustor and retort.

The present invention may be most easily understood by reference to the drawings. Shown in FIGS. 1 and 2 are schemes for recovering shale oil from oil shale. One skilled in the art will recognize that with appropriate modification the same basic processes may also be employed to recover product oil from tar sand.

Shown in FIG. 1 is a retorting vessel 2, a combustor 4, a coking vessel 6, and a fractionator 8. In the retorting vessel the particulate raw shale feed entering the retort via conduit 10 is mixed with hot heat transfer material entering by way of recycle feed pipe 12 to form a bed of solids 14. An inert stripping gas is introduced into plenum chamber 16 and passes upward through distributor grate 18 and through the bed of solids. Depending upon the velocity of the stripping gas the bed of solids may be fluidized or only partially fluidized. At low gas velocities the bed may also form a vertical moving packed bed. However, as will be discussed later the velocity of the stripping gas must be sufficient to significantly lower the dew point of the high-boiling fraction. A mixture of pyrolyzed solids and heat transfer material is withdrawn from the retort via drawpipes 20*a* and 20*b*.

The pyrolyzed product vapors and entrained solids leave the top of the bed and enter cyclones 22 and 24 which remove most of the entrained fines and return them to the bed by diplegs 26 and 28, respectively. The product vapors and entrained fines not collected by the cyclones leave the retort via outlet conduit 30 and are sent to the fractionator 8 where the raw shale oil is separated from non-consensible gas, and lighter products.

In the embodiment shown the contaminants are selectively enriched in the fractionator bottoms 32 which is withdrawn via conduit 34. Kerosene/diesel and gas oil are removed from the fractionator via conduits 36 and 38, respectively, while light overhead gases are recovered by overhead outlet 40. The overhead gases pass through cooler 42 where the condensible gases are cooled sufficiently to become liquid. In separator 44 non-condensible gases are recovered via outlet 46 separately from naphtha which is recovered via conduit 48. Naphtha is recycled to the top of the fractionator via recycle conduit 50.

The heavy oil collected as bottoms is either recycled to the fractionator via conduits 52 and cooler 54 or alternatively is sent to the coking vessel 6 via conduit 56.

Returning to the retort, the mixture of heat transfer material and pyrolyzed shale leaving the retort is carried by conduit 58 to the engaging section 60 of the combustor 4. In the engaging section, the particles of heat transfer material and pyrolyzed solids are entrained in a stream of air having sufficient velocity to carry the solids up the length of liftpipe 62. In the liftpipe the carbonaceous residue which remains in the pyrolyzed solids following retorting is at least partially burned. The partially burned particles exit the top of the liftpipe and enter the secondary combustion and separation chamber 64. Secondary air entering the bottom of chamber 64 via secondary air inlet 66 and plenum 68 serves as fluidization gas for the fluidized bed 70 in the bottom of the chamber and as a source of oxygen for the combustion of any unburned carbon residue in the solids. The flue gas and fines leave the combustor by means of flue gas outlet 72.

Excess solids which are not recycled through the coking zone to the retort are removed from the system by drawpipe 79. Preferably, the secondary combustion and separation chamber is designed to separate the finer more friable material from the coarser more attrition resistant particles which are more desirable for use as heat transfer material.

At least part of the hot solids in the fluidized bed 70 will be recycled as heat transfer material. From the secondary combustion and separation chamber 64 the heat transfer material is carried by solids feed pipe 74 to the coking vessel 6. In the coking vessel, the heat transfer solids form a fluidized bed 76 the depth of which is controlled by an overflow weir of baffle 78. In the embodiment shown, the heavy oil from the fractionator bottoms is mixed with steam and introduced into the coking zone as a component of the fluidizing gas. Alternatively, the heavy oil may be introduced directly into the fluidized bed of the coking zone. The hot heat transfer material in the coking zone will have a temperature in the range of from about 900° F. to about 1500° F. depending on the combustor outlet temperature of the heat transfer material and the flow rate of the heat transfer material relative to the heavy oil fraction. Under these conditions, the heavy oil will be thermally cracked to produce a lower boiling product of reduced molecular weight. The coke deposited on the heat transfer particles contained in the bed will also contain most of the particulate matter and most of the iron, magnesium, sodium, and calcium contaminants and a fraction of the nitrogen and arsenic contaminants.

In the embodiment shown in FIG. 1, the solids feed pipe 74 is immersed in the fluidized bed of the coking zone. Thus, in operation it is normally full of solids effectively producing a gas seal between the combustor and the coking zone. The recycle feed pipe 12 which serves to carry heat transfer material to the retorting vessel 2 operates essentially empty thus allowing gases to flow into the retort. In an actual commercial design more than one recycle feed pipe may connect the coking zone with the retort. In this embodiment the coking zone also acts as a control device which both prevents the exchange of gases between the retort and combustor and meters and distributes the flow of heat transfer material into the retort.

An alternate means for coking the heavy oil is shown in FIG. 2. The operation of the combustor, retorting vessel, and fractionator is the same as that discussed in FIG. 1. In this embodiment the coking zone takes the form of a feed chute 102 partially filled with the recycled heat carrier material. Hot heat transfer material leaving the fluidized bed in the secondary combustion zone 104 enters and exit drawpipe 106 having a 90° bend 108 which acts as an L-valve to form a seal between the combustor and the feed chute 102. The feed chute contains an upper weir 110 which maintains the solids entering the chute at a predetermined level by damming up the flow as the solids move down the chute. Steam mixed with contaminated heavy oil from the fractionator bottoms is introduced as a spouting gas through gas inlet 112 located just upstream from weir 110. The gas leaves the gas inlet as a velocity sufficient to locally fluidize the heat transfer particles just upstream from the weir. It is in this fluidized zone where the thermal cracking of the heavy oil occurs and the coking of heat transfer particles takes place.

The fluidized heat transfer material readily flows over the upper weir and down the mid-portion of the chute. Since the chute is at an angle which exceeds the angle of slide of the heat transfer material, the solids will move down the mid-portion of the chute. The level of the moving bed in the mid-portion of the chute is controlled by a lower weir 114 located near the mouth 116 of the chute. A second gas inlet 118 just upstream from the lower weir 114 acts as a second cracking and coking zone for heavy oil entering with the spouting gas in this region.

In the case of recycled oil shale having a maximum particle size of about ¼ inch, the angle of slide on stainless steel is about 3o° and the angle of internal friction about 60°. A suitable chute angle is about 45° to allow high solids throughputs and to insure that no stoppages occur in the flow of solids.

One skilled in the art will recognize that other means besides the fractionators shown in FIGS. 1 and 2 may be employed to collect the heavy oil. For example, the heavy oil may be collected in a spray tower cooled by recycle oil or by water injection. The means used is not important so long as the heavy oil may be collected with the contaminants separately from the lower boiling products.

As already noted the design of the retorting vessel may take a number of forms so long as it is adapted to employ a heat transfer material and a stripping gas which in the present scheme is essential to lower the dew point of te heavy oil. Likewise, the design of the combustor may take any number of known forms so long as it is able to supply a sufficient quantity of heat transfer material at a temperature capable of cracking the heavy oil and subsequently heating the raw feed to pyrolysis temperature. Various designs for the coking zone may also be contemplated by one skilled in the art. Generally, the coking zone will employ either a fluidized or partially fluidized bed of heat transfer material. Although in FIG. 1 the fluidized coking zone is shown above the retort, the coking zone may also be on the side of the retort or internal to the retort. In the two latter embodiments, heat transfer solids will flow over a weir directly onto the bed of solids contained in the retort.

Figure 3:
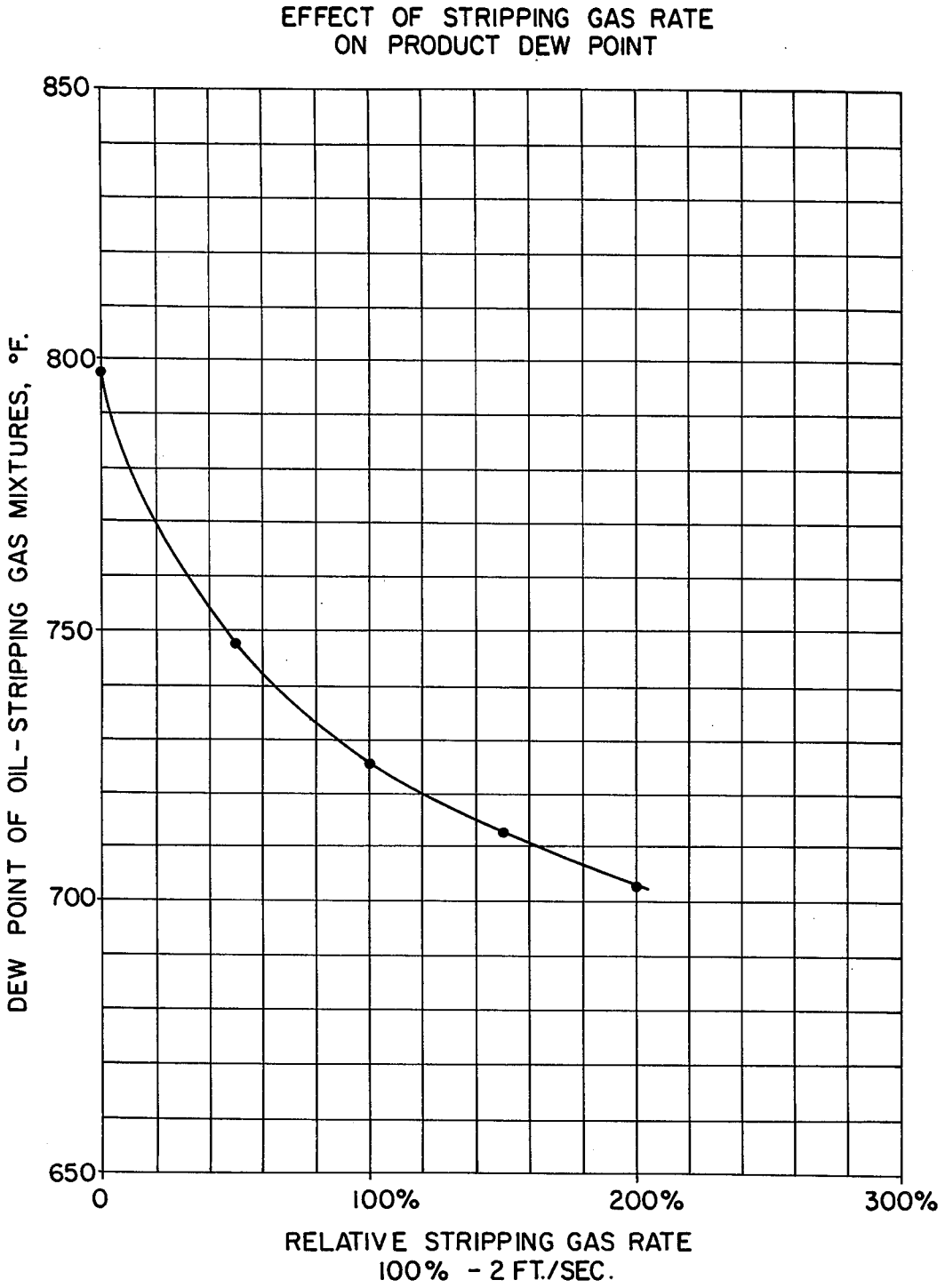
FIG. 3 is a graph illustrating the change in dew point observed in shale oil resulting from different stripping gas rates.

The importance of the presence of stripping gas in the shale oil vapor for the purpose of the invented process is demonstrated by FIG. 3. FIG. 3 shows the dew point of shale oil vapor-stripping gas mixtures as a function of injected stripping gas rate (100% corresponds to 10 moles of stripping gas per average mole of oil produced or a superficial stripping gas velocity of about 2 ft/sec. for a raw shale throughput of 4,000 lbs/hr. $ft^2$ and a shale grade of 27 Gal/ton). An increase in stripping gas rate from 0 to 100% is shown to decrease the dew point by 70° F. This means that a heavy oil condenser with 100% stripping gas can be operated at a temperature approximately 70° F. lower than the corresponding case without stripping gas (same heavy oil fraction condensed).

Figure 4:
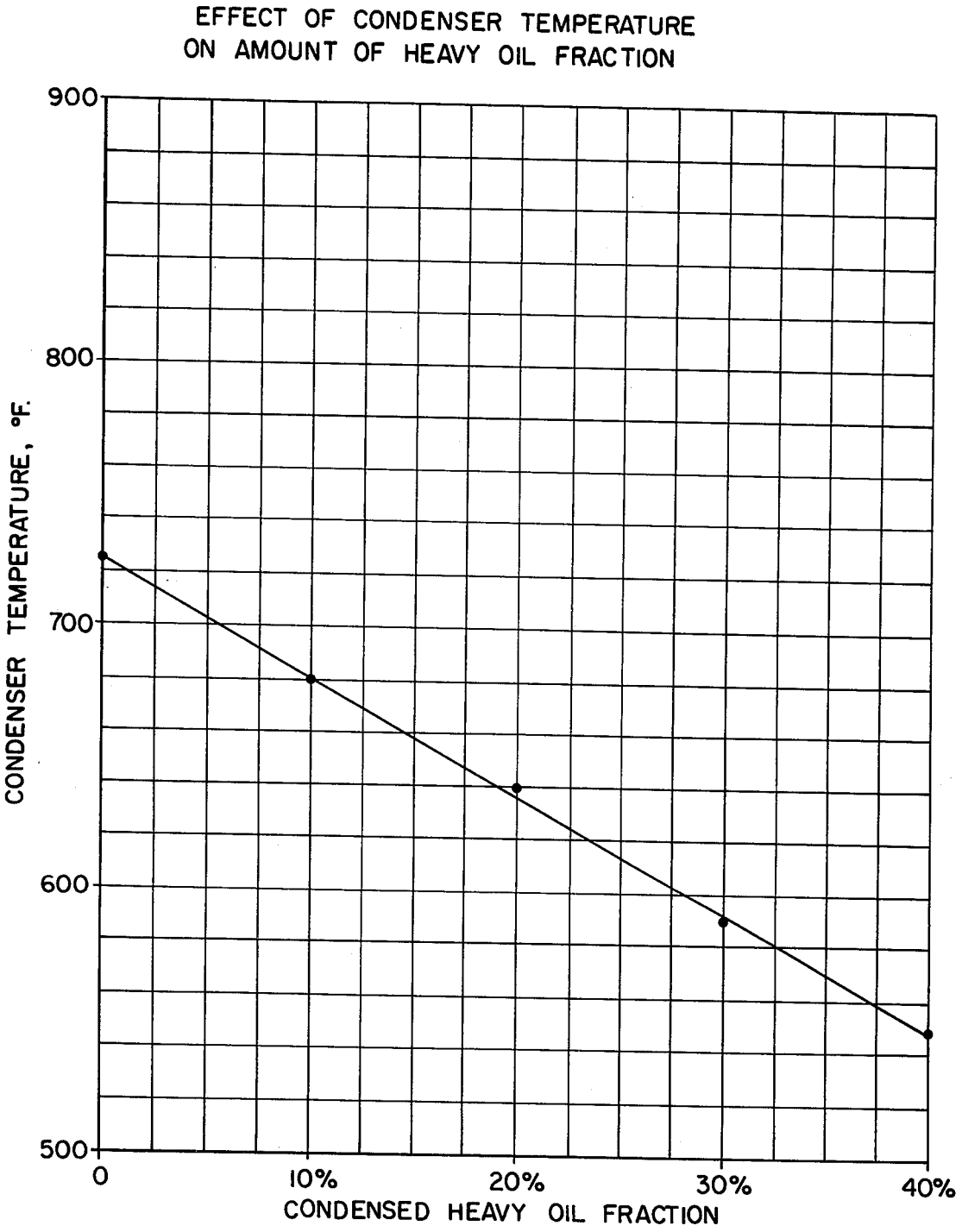
FIG. 4 shows in graphic form the effect of condensation temperature on the amount of heavy oil fraction.

FIG. 4 shows the amount of heavy oil condensed as a function of condenser temperature for the 100% stripping gas case. It is seen that a condenser temperature in the range 680°–550° F. produces a heavy oil fraction amounting to 10–40% of the primary shale oil production. Heavy oil temperatures higher than about 650° F. are undesirable because of the rapid coking reactions that occur at these elevated temperatures in the liquid-phase heavy oil. Rapid coking can result in plugging of the entire condenser system. Consequently, in the absense of stripping gas it is necessary to condense a much larger heavy oil fraction because of the dew point effect. This in turn leads to increased coke yield in the cracking step thus reducing the net oil yield.

Figure 5:
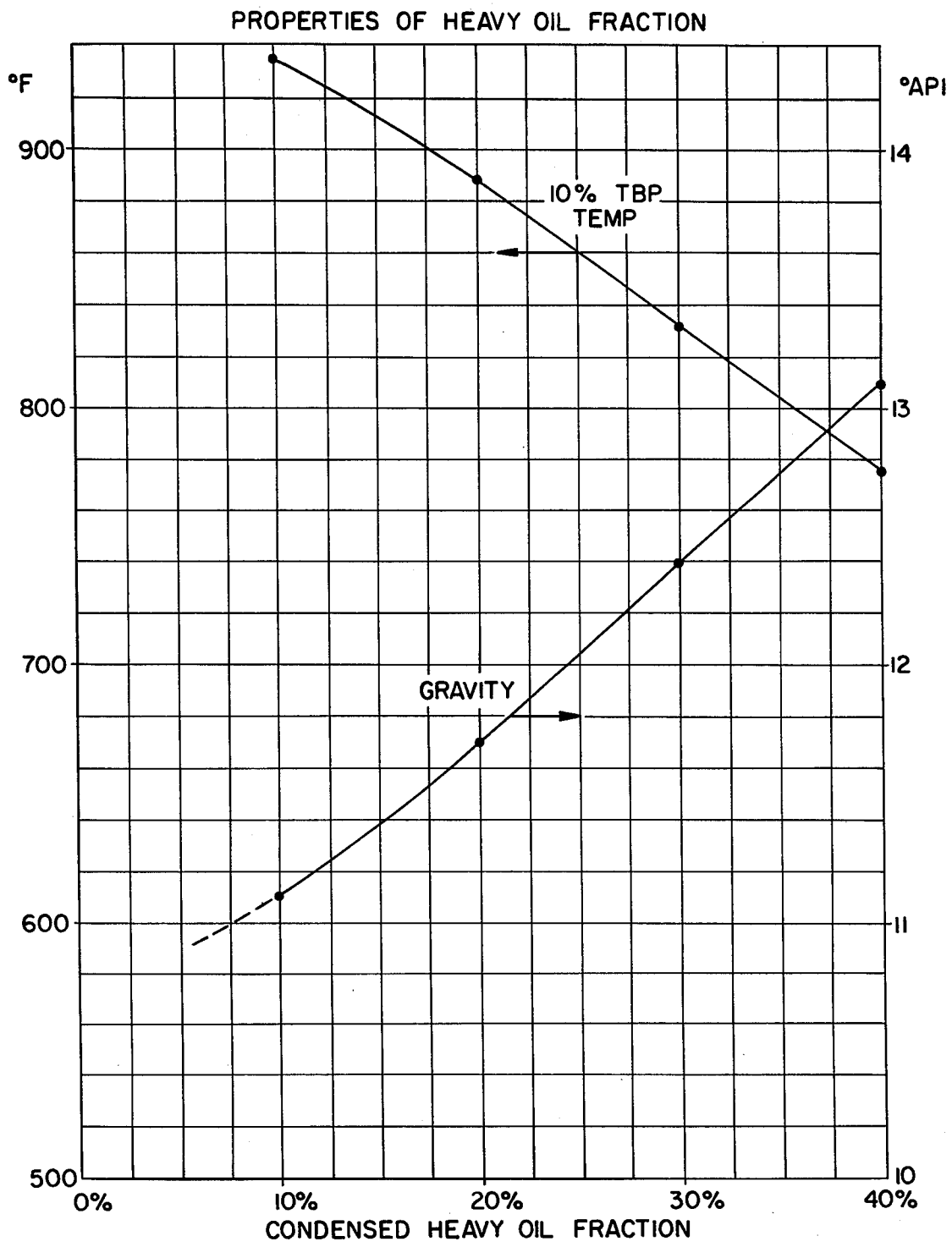
FIG. 5 shows the physical properties of the heavy shale oil fraction.

FIG. 5 shows the 10% true-boiling point temperature and the API gravity of the condensed heavy oil fraction. For comparison, the primary shale oil has a 10% TBP temperature of 300° F. and a gravity of 22° API. A 10% heavy oil fraction is seen to be mostly 935° F.+ material (90% boiling above 935° F.), a 20% heavy oil fraction is 890° F.+ and a 30% heavy oil fraction is 830° F.+. Thus, one skilled in the art will recognize that by lowering the dew point of the pyrolysis oil, it is possible to condense the contaminants in a smaller high-boiling fraction. As noted above, this objective may be accomplished by passing a stripping gas through the retort during pyrolysis of the raw feed.

In carrying out the invention, preferably at least 90% of the high-boiling fraction will have a boiling point above about 850° F. and more preferably above 950° F.

What is claimed is:

1. An improved process for retorting a hydrocarbonaceous solid selected from the group consisting of oil shale and tar sand to recover pyrolysis oil of a lower average molecular weight and containing less contamination which comprises:

(a) pyrolyzing a mixture of particulate raw hydrocarbonaceous solid by mixing it with a hot particulate heat transfer material in a retorting vessel and maintaining said mixture at a temperature sufficient to pyrolyze the solid hydrocarbonaceous fraction for a time sufficient to decompose a significant amount of the solid hydrocarbonaceous fraction to hydrocarbon vapors;

(b) passing an inert stripping gas through the mixture of hydrocarbonaceous solids and heat transfer material at a rate sufficient to significantly lower the dew point of the evolved hydrocarbon vapors;

(c) recovering as a pyrolysis product from the raw hydrocarbonaceous solid a contaminated hydrocarbon vapor;

(d) condensing from the contaminated vapor at a temperature of between 550° F. and 680° F. a high-boiling fraction containing concentrated contaminants, said high-boiling fraction being comprised of at least 90% hydrocarbons having a boiling point above 850° F.;

(e) contacting the contaminated high-boiling fraction with at least a portion of the hot heat transfer material in a coking zone prior to said heat transfer material portion being mixed with the raw hydrocarbonaceous solid in step (a) so as to thermally crack the high-boiling fraction and to deposit the contaminants along with coke on the heat transfer material;

(f) recovering a product oil from the coking zone having a lower average molecular weight and having substantially reduced contamination as compared to the high-boiling fraction; and (g) mixing the coked heat transfer material with the raw hydrocarbonaceous solid.

2. The process of claim 1 wherein the retorting vessel is a vertical vessel designed to control gross vertical backmixing wherein the heat transfer material and particulate raw hydrocarbonaceous solid is introduced into the top of said vessel and the pyrolyzed solids and heat transfer material are withdrawn from the bottom.

3. The process of claim 2 wherein the retorting vessel contains a staged turbulent bed.

4. The process of claim 1 wherein the heat transfer material is recycled pyrolyzed hydrocarbonaceous solids.

5. The process of claim 1 wherein the temperature of the heat transfer material in the coking zone is within the range of from about 900° F. to about 1500° F.

6. The process of claim 1 wherein the heat transfer material is maintained in a fluidized bed in the coking zone.

7. The process of claim 1 wherein the heat transfer material is maintained in a partially fluidized bed in the coking zone.

8. The process of claim 1 wherein at least 90% of the high-boiling fraction boils above about 950° F.

* * * * *

UNITED STATES PATENT AND TRADEMARK OFFICE

CERTIFICATE OF CORRECTION

PATENT NO. : 4,456,525

DATED : June 26, 1984

INVENTOR(S) : Byron G. Spars et al.

It is certified that error appears in the above-identified patent and that said Letters Patent is hereby corrected as shown below:

| | |
|---|---|
| Col. 2, Line 11, | "As" should begin a new paragraph |
| Col. 2, Line 23, | "succh" should read --such-- |
| Col. 3, Line 24, | "consensible" should read --condensible-- |
| Col. 3, Line 39, | "conduits" should read --conduit-- |
| Col. 4, Line 53, | "as" should read --at-- |
| Col. 5, Line 3, | "3o°" should read --30°-- |
| Col. 5, Line 18, | "te heavy oil" should read --the heavy oil-- |

Signed and Sealed this

*Twenty-sixth* Day of *February 1985*

[SEAL]

*Attest:*

DONALD J. QUIGG

*Attesting Officer* *Acting Commissioner of Patents and Trademarks*